US006807800B2

(12) United States Patent
Rosenwasser et al.

(10) Patent No.: US 6,807,800 B2
(45) Date of Patent: Oct. 26, 2004

(54) JEWELRY ROPE CHAIN

(75) Inventors: David Rosenwasser, Norwood, NJ (US); Avi Rosenwasser, 100 Rio Vista Dr., Norwood, NJ (US) 07648

(73) Assignee: Avi Rosenwasser, Norwood, NJ (US)

( * ) Notice: Subject to any disclaimer, the term of this patent is extended or adjusted under 35 U.S.C. 154(b) by 21 days.

(21) Appl. No.: 10/074,692

(22) Filed: Feb. 12, 2002

(65) Prior Publication Data

US 2003/0150203 A1 Aug. 14, 2003

(51) Int. Cl.[7] ..... B21L 5/02; F16G 13/00

(52) U.S. Cl. ..... 59/80; 59/3; 59/83; 59/35.1; D11/13

(58) Field of Search ..... 59/3, 80, 83, 35.1; D11/13

(56) References Cited

U.S. PATENT DOCUMENTS

D277,369 S * 1/1985 Otake ..... D11/13
4,651,517 A 3/1987 Benhamou et al.
4,934,135 A 6/1990 Rozenwasser
4,996,835 A 3/1991 Rozenwasser
5,309,704 A * 5/1994 Grando ..... 59/35.1
5,797,258 A * 8/1998 Strobel et al. ..... 59/35.1
6,532,725 B1 * 3/2003 Chia et al. ..... 59/35.1
6,560,955 B1 * 5/2003 Chia et al. ..... 59/80

* cited by examiner

*Primary Examiner*—David Jones
(74) *Attorney, Agent, or Firm*—Katten Muchin Zavis Rosenman

(57) ABSTRACT

A jewelry rope chain having links interwoven together to form a double helix configuration. Each link has a cross section with the largest transverse distance across the cross section defining a first dimension. Each link has a interior space and a gap along the periphery of the length. The widest dimension of the interior space in a direction consistent with the direction of the gap has a dimension which is less than three times the first dimension. Thus, ratios of approximately 2:1 can be achieved.

20 Claims, 4 Drawing Sheets

JEWELRY ROPE CHAIN

FIELD OF THE INVENTION

This invention relates to jewelry rope chains and more particularly to a jewelry rope chain having a novel construction requiring less labor time for such construction.

BACKGROUND OF THE INVENTION

Jewelry rope chains are a specific type of chain product formed by intertwining links in a particular manner whereby the result is a double helix configuration. Such jewelry rope chains are well known in the art and are generally formed of precious metal. Although the links can be formed of numerous shapes and configurations, the generally accepted classic jewelry rope chain is formed of an annular shaped link. Similarly, although numerous cross sectional shapes of the link wire are well known, the classic jewelry rope chain has been formed of round wire. In the case of solid rope chain, solid wire is utilized. In the case of a hollow rope chain, the wire is of tubular configuration. Such hollow links formed of the hollow tubular wire, can either be formed with a seam along the inner periphery of the link or can be seamless without such seam. The purpose of the seam being to permit removal of a core placed in the interior of the tubular wire to provide support to the links during construction of the chain.

With respect to an annular shaped link and using round solid or tubular wire, historically, rope chains have been formed using what has been referred to as a 3:1 ratio. This refers to the ratio of the inner diameter of the link to the thickness of the wire. With the 3:1 ratio, three links would be intertwined and fit within the inner diameter of an initial link as they are woven together. Thereafter, for a 3:1 ratio, a fourth link would then come along and be intertwined into the other three and such would start the beginning of a next series of again three links inserted into that link.

It should be appreciated, that in order to fit three links into an inner diameter, the inner diameter must be slightly greater than three times the thickness of each of the wires forming the link. Typically, the actual ratio may be in the neighborhood of 3.4–3.7:1. However, since it is understood that some additional room must be permitted to accommodate manipulation, the ratios are still referred to as 3:1 ratio. It should be understood, however, that hereinafter whenever ratios are given that the ratios are slightly greater to accommodate manipulation room.

Each of the links being utilized to form the rope chain has a gap formed along its surface extending between the outer periphery and the inner periphery. In the 3:1 ratio, the links are assembled alternately with one link having its gap in the up position and thereafter the next link being inserted with its gap 180θ in opposition so that the gap is in the down position. This alternating relationship continues throughout the assembly. After all of links in the entire chain have been assembled, they are wrapped around a wire and alternating pairs of links are joined together typically using solder. Thus, two links are joined together and loosely connected between the next pair of links that are also joined together.

U.S. Pat. No. 4,651,517 provided an improvement on such historic 3:1 ratio by making the thickness of the wire diameter of the link smaller and the inner diameter larger, whereby it would be possible to achieve greater ratios such as 5:1, 7:1, etc. Thus, instead of placing three links within the inner diameter of another link, you would place five links or seven links within the inner diameter. Because of the thinner links, less material is used for each link. However, since the thickness of the wire used for each link is reduced, a greater number of links per fixed length would be needed with the higher ratios being used. Nevertheless, even though a greater number of links are required for a fixed length, because there is substantially less material in each link, there is a considerable saving in material using ratios of 5:1 or 7:1 or higher.

U.S. Pat. No. 4,651,517, however, is limited to odd ratios since it describes the same method of assembling the links wherein one link is inserted with its gap in the upright position and the next link is inserted with its gap approximately 180θ opposed to the first gap. Thereafter, the links are assembled alternatingly with the gap being upward and the gap being downward.

U.S. Pat. No. 4,651,517 only identified odd ratios. Subsequently, U.S. Pat. No. 4,934,135 described a jewelry rope chain using even number ratios such as 4:1, 6:1, etc. In this arrangement, however, the assembly technique is modified so that certain groupings of adjacent links are inserted with their gaps in the same orientation and these links having their gaps with the same orientation are fixedly attached to one another to form a single group. This group is then attached to another one or another group of links with their gap in the opposite direction.

Despite both these patents, the bottom limit that has ever been utilized for forming jewelry rope chain has been the ratio of 3:1.

SUMMARY OF INVENTION

It is accordingly an object of the present invention to provide a jewelry rope chain with links having gaps which are interwoven to form a double helix configuration and having a ratio of less than 3:1 of link inner diameter to wire diameter.

It is a further object of the present invention to provide a jewelry rope chain having a ratio of less than 3:1 which requires less labor costs to assemble.

Yet another object of the present invention is to provide a jewelry rope chain having a ratio of inner diameter to wire thickness of less than 3:1 and which method of assembly can be applied to both hollow and solid rope chain, rope chains of different link size and shape, rope chains formed of different wire shapes, seam and seamless hollow rope chain, and both machine and manual assembly.

In accordance with the present invention, there is provided a jewelry rope chain having links which are interwoven together to form a double helix configuration. Each of the links have a cross section with the largest transverse distance across the cross section having a dimension $d_w$. It should be appreciated that in the case of solid links this would be the cross section of the wire and in the case of hollow links this would be the cross section of the tubing used to form the link.

Each link also has an outer periphery and an inner periphery with a gap extending at one location between the outer periphery and the inner periphery. The inner periphery defines an interior space. The widest dimension of the interior space in a direction consistent with the direction of the gap has a dimension D, wherein D is less than three times $d_w$. Thus, two links are placed within the interior diameter of a third link. It should be appreciated that in the case of an annular link, the dimension D would be the inner diameter of the link. In the case of round wire or tubing used to form the link, it would be the diameter across the wire or across the wire tubing which would be $d_w$. However, link shapes other than annular could be used and wire or tubing cross sections other than round could also be used.

In forming the chain, pluralities of assemblies of links are connected in series. Each assembly comprises two adjacent links placed into the interior of a prior link, and an end link enveloping these two adjacent links. The two adjacent links have their respective gaps assembled in the same orientation and are fixed to each other to form a group. This group is then attached to the end link, which has a gap orientation about 180 degrees removed with respect to the gaps of the links in the group.

In the case of a hollow rope chain, it will be shown that the amount of precious metal, such as gold, needed for this ratio is about the same as the standard classic 3:1 ratio type of chain. The reason for this is that even though each link will be thicker and therefore have a greater amount of precious material in it, there are less links required in a fixed length of the chain so that the result is almost identical to that using a standard 3:1 ratio.

However, because there are a reduced number of links in a fixed length of the chain, there is considerable savings in labor costs. For example, there are approximately 20% less links which normally result in a savings of approximately 20% labor costs.

Furthermore, even in the case of solid links, where additional precious material would be used, there is still the cost savings cost. The gold, even though more is being used, is recoverable. The labor costs, unfortunately, are never recoverable and therefore the savings in labor result in a reduced cost for manufacturing.

Additionally, because the link will be thicker and a smaller interior space provided, the link will be stronger, thereby providing a stronger rope chain. Furthermore, because of the thicker link, when faceting the link or deforming it to from a simulated facet, the facet area will be larger thereby providing a more sparkling chain.

DETAILED DESCRIPTION OF THE PREFERRED EMBODIMENTS

Figure 1:
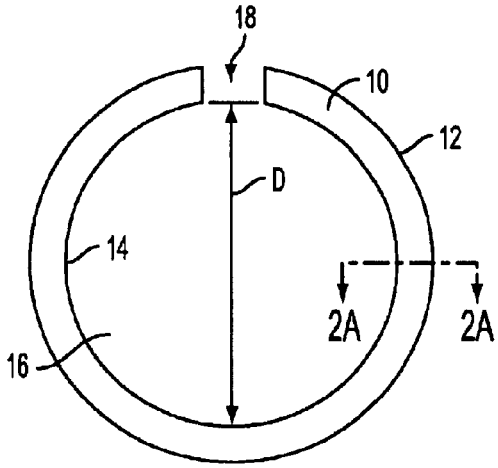
FIG. 1 is a schematic of an annular link used to form a jewelry rope chain.

FIG. 1 illustrates an annular link utilized in forming a jewelry rope chain. The annular link 10 has an exterior periphery 12 and an interior periphery 14. The interior periphery defines an interior space 16. A gap 18 is formed extending between the exterior periphery and the interior periphery at one location about the annular link. The annular link is shown to have a diameter D. The diameter in this case is uniform throughout the interior. However, as hereinafter will be explained, the diameter of significance is that measured along the dimension consistent with the direction of the gap 18.

Figure 3:
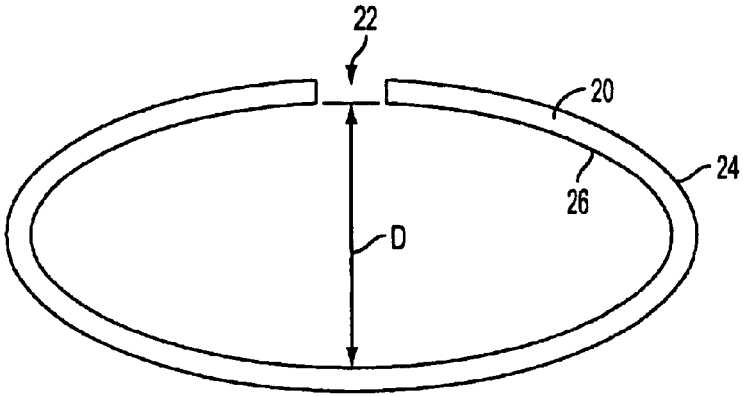
FIG. 3 shows an oval link for use in making a jewelry rope chain.

By way of example, FIG. 3 also shows a link 20 useful in forming a rope chain in accordance with the present invention. Link 20 has a gap 22 extending between the exterior periphery 24 and the interior periphery 26. In this case, the dimension D is measured in the direction of gap 22 and constitutes the minor diameter of the oval configuration shown by the link. In each case, regardless of the shape of the link, the dimension D is measured in the direction of the gap since this is the dimension that must accommodate the interweaving of the links.

Figure 2A:
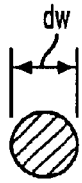
FIGS. 2A–2D show various cross-sections of the link.

The cross section of the link is shown in FIG. 2A which shows that the link of FIG. 1 is formed of solid material. In this case, it is formed of a solid wire of circular cross section with a diameter $d_w$.

Figure 2D:
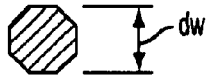
Figure 2B:
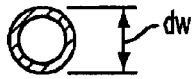
Figure 2C:
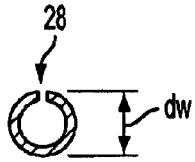

However, it should be appreciated that the links can be hollow links, as shown in FIG. 2B, and would then be formed of tubular material. In this case, the tubular material is again annular and therefore has a diameter which is uniform at $d_w$. In the case of FIG. 2B, the tubing is complete without any seam. In the tubular material shown in FIG. 2*c*, a seam 28 is provided. The purpose of the seam is to permit removal of the core material placed in the center of the tubular wire to provide rigidity during the formation of the jewelry rope chain. The presence of the seam permits removal of such core material through melting.

As shown in FIG. 2D, the cross section of the wire forming the annular link need not be circular. Any other shape can be utilized. FIG. 2D shows by way of example, a hexagonal shape wire. In this case, the maximum dimension of the cross section is shown as $d_w$. It is this maximum cross section that is of significance. Of course, other shapes can be utilized not only for solid wire but for hollow wire.

In forming the jewelry rope chain, individual links are interwoven together to form assemblies. Typically, rope chains have been formed in the ratio of 3:1. Thus, the interior dimension D would be three times as large as the dimension of the wire $d_w$. As such, as the links are interwoven, one link is placed with its gap in the upward position, the next is placed with its gap in the downward position and enters into the first link. A third one is placed with its gap upward and again placed in the first link. This is continued until three links are contained in the interior space D of the link. Thereafter, a fourth link engulfs all of the three and starts a next assembly where three links will be occupying the space of the interior of that further link. Accordingly, the interior diameter must be large enough to hold three such links thereby providing a 3:1 ratio of the interior diameter of the maximum diameter of the wire $d_w$.

It should be appreciated, that although we use the nomenclature 3:1, in fact the interior diameter has to be larger than 3:1 to accommodate manipulation space. Thus, in fact, the interior would be 3.4:1 or 3.7:1. However, generally this is still referred to commonly as a 3:1 ratio.

Figure 9:
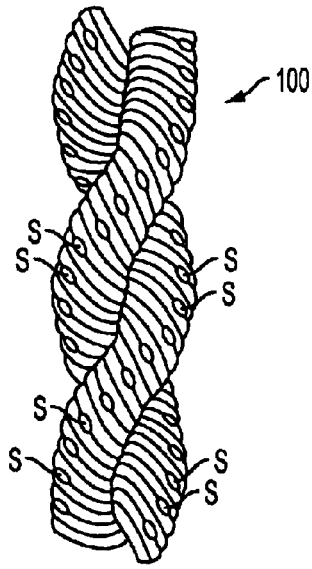
FIG. 9 is a schematic of a jewelry rope chain.

Once the chain is assembled, it is placed about a wire and then alternate ones of the links are soldered together to form a rope chain as shown in FIG. 9.

Figure 4A:
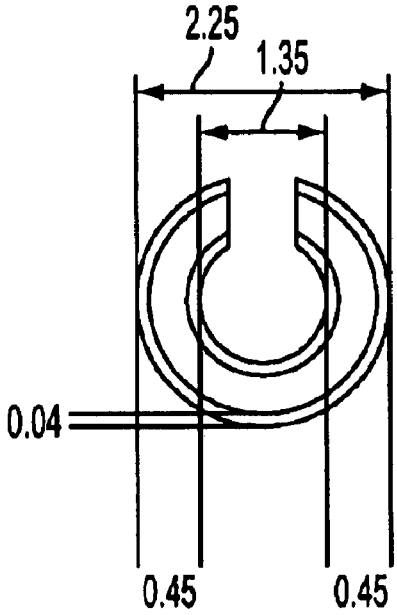
FIGS. 4A and 4B show a comparison respectively of a prior art link and a present link and showing the dimensions of each such link.

With reference now to FIG. 4A, there is shown a prior art hollow link which is used in the formation of a classical jewelry rope chain with a 3:1 ratio. The link is shown as being annular and being formed of a tubular material. The outside diameter of the link is shown to be 2.25 millimeters. In fact, this size would also define the total outside diameter of the chain. Thus, this link would be utilized to manufacture a 2.25 millimeter rope chain.

Using a 3:1 ratio, the inside diameter must accommodate three other links. It should also be noted, however, that the 2.25 outside diameter must thus be large enough to cover the two thicknesses of this link itself as well as the three additional links in the interior. Thus, the 2.25 millimeters divided by five gives that the maximum cross sectional dimension of the link which is 0.45 millimeters. The interior dimension D is thus 1.35 or three times the dimension $d_w$ which is 0.45. It is noted that the thickness of the sheet material forming the tube of the hollow link is a thickness of 0.04 millimeters.

Assuming a length of rope chain of one meter or 1,000 millimeters, the number of links required to fill the one meter length would be 1,000 millimeters divided by the width of each link or 0.45. This results in 2,222 links of this size that would be required for a one meter length of rope chain.

Calculating the amount of precious metal, such as gold, that would be required for this one meter length, we must calculate the volume of gold and then multiply it by the weight per unit volume of the gold. Since the same gold will be used, for comparison purposes, it is enough to calculate the differences in volume. The volume would be calculated by first calculating the area at a cross section of the link. Such cross sectional area can be determined by the formula:

$$A=\pi d_w t \quad 1.$$

Substituting the $d_w$ as being 0.45 and the thickness t as being 0.04, we calculate the surface area as follows:

$$A=3.14\times0.45\times0.04=0.05652 \quad 2.$$

To now calculate the volume of the gold material in a single link, we multiply that cross sectional area by the exterior length according to the following formula:

$$V=A\pi D \quad 3.$$

Substituting for the values indicated with the diameter being 2.25, the total volume is calculated as:

$$V=0.05652\times3.14\times2.25=0.39931 \quad 4.$$

To calculate the total volume for one meter, we multiply the volume just calculated by the total number of links required in a meter, namely 2,222 as follows:

$$V\text{meter}=0.3999\times2222=887.27 \quad 5.$$

It should be appreciated, that we have not taken into consideration the gap that exists in the chain. As the calculation is for comparison purposes only, the gap will not affect the comparison very much.

Figure 4B:
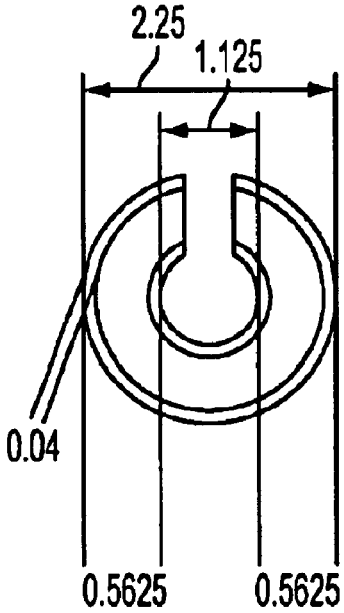

With reference now to FIG. 4B, the link being utilized for the present invention only includes two links in the interior diameter of any other link. Accordingly, the total extent across the 2.25 millimeter outside diameter would include the two widths of the link itself plus two additional widths of links in the inner diameter, making a total of 4 widths. Dividing the outside diameter of 2.25 by 4 provides a thickness of each link of 0.5625. The interior diameter of the new link would be 1.125 which would accommodate such two links. It should thus be appreciated that the thickness of the link is greater than that of the prior art using the 3:1 ratio.

However, the number of links required in a one meter length is now calculated by dividing 1,000 millimeters by the new thickness of 0.5625 getting a total of 1,777. This is a 20% reduction in the number of links required.

Calculating the volume of gold required will again be done as above. Using formula 1 to calculate the area, we arrive at the following:

$$A\ 32\ 3.14\times0.5625\times0.04=0.07065tm \quad 6.$$

The total volume of the link is calculated using formula 3 above as follows:

$$V=0.07065\times3.14\times2.25=0.49914 \quad 7.$$

And in the total volume for one meter is calculated as follows:

$$V\text{meter}=0.49914=1777=886.98 \quad 8.$$

It will thus be appreciated, that using the 2:1 ratio, although it results in a larger link, it also results in a reduced number of links for a given length and the total amount of gold being used is almost identical with the prior art 3:1 ratio.

Accordingly, a hollow rope chain being manufactured in accordance with the present invention, as per the example given, would not require any greater amount of gold to produce the same effective looking chain. However, 20% less links in number would be used requiring 20% less labor to assembly the links. Even if machines were used to manufacture the links, it would take 20% less time and 20% less monitoring by employees. Thus, there is a considerable saving in labor, time and thus manufacturing costs to produce the same chain.

It is appreciated that if solid links were used, there would be an increase in the amount of gold needed to produce the chain of the present invention. However, as chains are typically sold by weight, there would in fact be a greater amount of weight in the chain and such gold is always recoverable by its weight. However, the labor savings would be identical as with the hollow chain. Thus for a solid chain of the present invention, while it would in fact contain more gold, the labor cost which is not recoverable, would be reduced.

It should also be appreciated that because the link of the present invention is larger and has a smaller inside diameter, it does present a structurally stronger link whereby the chain that is produced by using such links would in fact be a stronger chain. Furthermore, because of the thicker wire, if the chain were faceted or simulated facets formed, the facet size would be bigger providing a more sparkling chain.

Figure 5B:
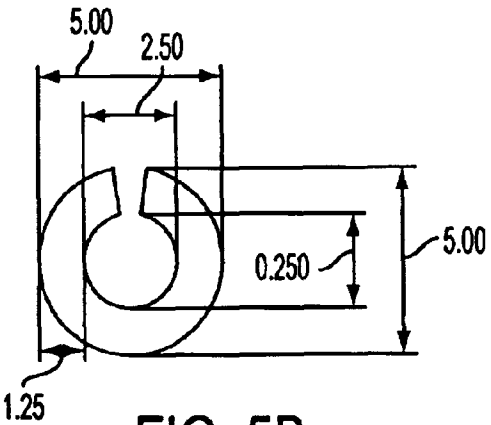
FIGS. 5A and 5B show comparisons respectively of a prior art annular link and a present invention annular link.
Figure 5A:
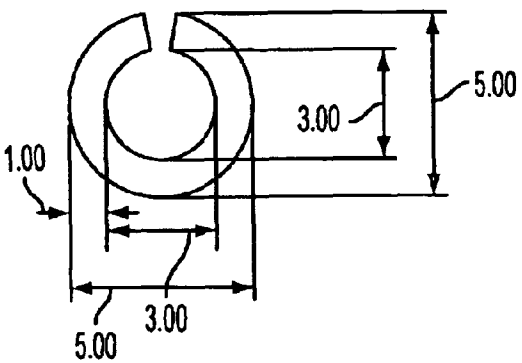

By way of example, other sizes and shapes of links could likewise be utilized. For example, FIG. 5A shows a prior art link having an outside diameter of 5 millimeters. Using the prior art 3:1 ratio, the thickness of each link would be one millimeter and the inside diameter would be 3 millimeters to accommodate three additional links. As shown in FIG. 5B for a similar 5 millimeter outside diameter, since only two links are required in the inside diameter, the link thickness would be 1.25 millimeters and the inside diameter of the link would be 2.5 mm to accommodate two links.

Figure 6A:
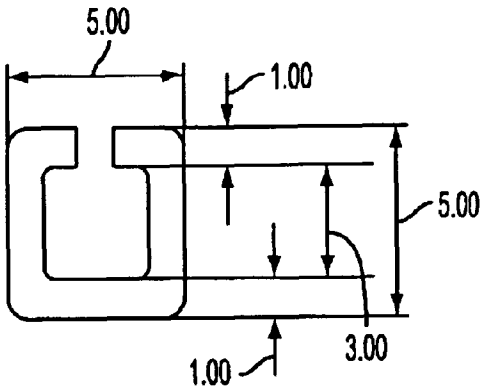
FIGS. 6A and 6B show respectively comparisons of a prior art square link and a present invention square link.
Figure 6B:
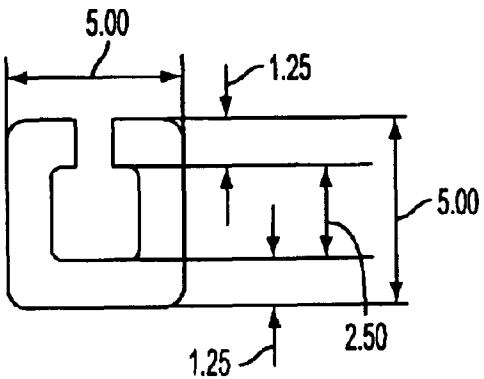

As shown in FIG. 6A, the present invention can also be applied to other shapes rather than an annular shape. By way of example, the square link shown in FIG. 5A is one of the prior art using a 3:1 ratio. Again, with the outside dimension being 5 millimeters, since three links must fit in the interior, the link thickness would be one millimeter. In 6B, using the present invention again for a 5 millimeter outside dimension, the thickness of each link would be 1.25 millimeters and the interior dimension would be 2.5 to accommodate two such links.

Figure 7A:
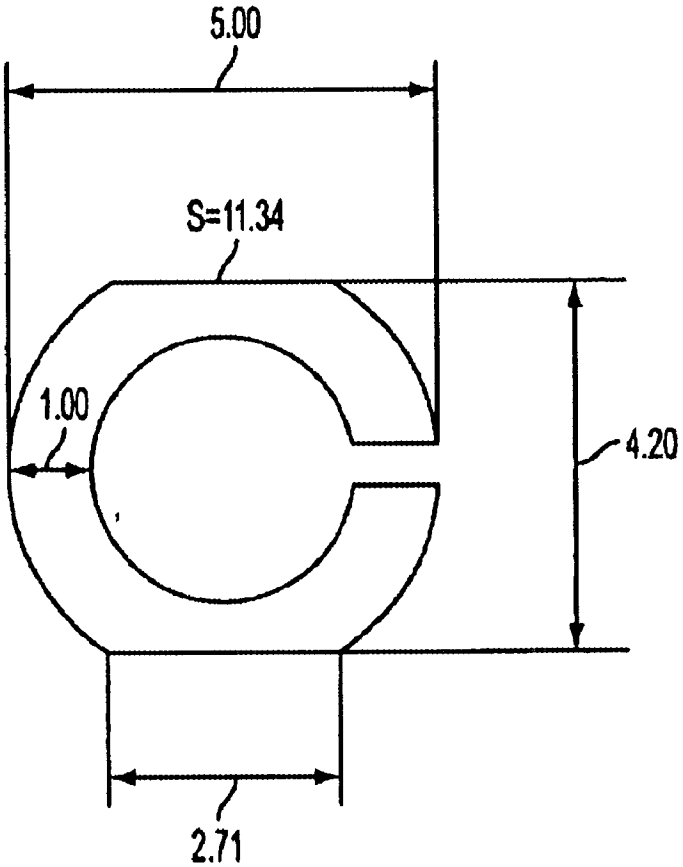
FIGS. 7A and 7B show respectively comparisons of dimensions of an uniquely shaped link using prior art teachings and present invention techniques.
Figure 7B:
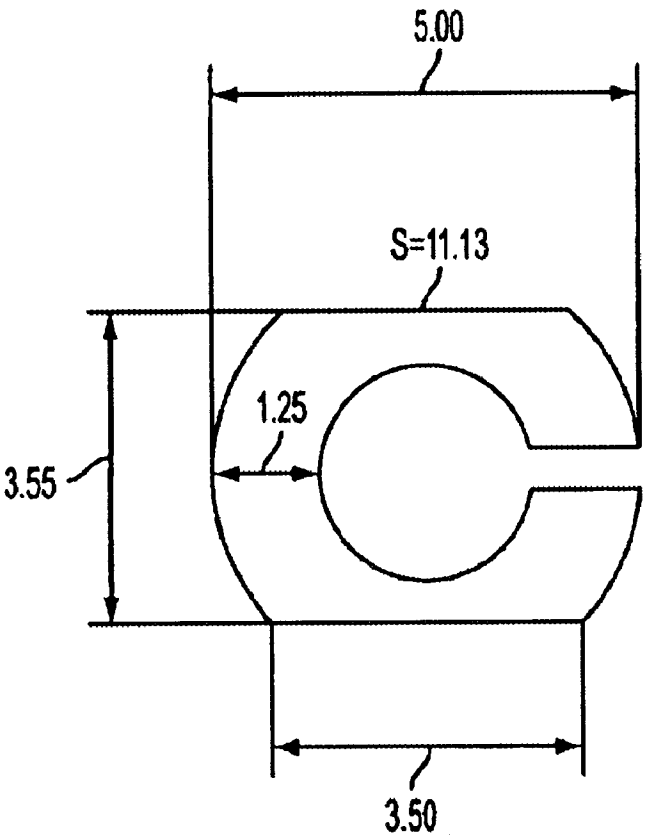

As shown in FIGS. 7A and 7B, an additional benefit that can be achieved by the present invention is to provide a greater surface for faceting of the rope chain. For example, using the link shown in FIG. 5A, with an outside diameter of 5 millimeter and a wall thickness of one millimeter, the approximate length of surface available for faceting is 2.71 millimeters. As shown in FIG. 7B, however, with the link of the present invention, although the outside diameter is still 5.0 millimeters, the wall thickness is 1.25 millimeter, thereby permitting a greater depth of cut on the link so that the surface available for faceting is 3.50 millimeters. Having a greater surface area for faceting produces a greater luster and more brilliant rope chain.

Even with hollow rope chain, the greater thickness of the link will provide a greater facet size with simulated faceting techniques.

Because there are an even number of links contained within the interior, the method of assembling the present invention would have to relate to the method suggested in U.S. Pat. No. 4,934,135 by the present inventor, the entire patent of which is herein incorporated by reference. As explained in that patent, when utilizing an odd number of links in the ratio, such as 3:1, 5:1, etc., the links can be assembled by having one link with its gap in the upright position and the next link with the gap in the downward position and alternatingly assembling them with one up and one down. Thereafter, after all the links are assembled, they are placed about a spiral wire and alternate groups of two are secured together, typically by solder.

However, when utilizing an even number of links, adjacent links must be assembled with their gaps aligned and oriented in the same direction. Such adjacent links having their gaps oriented in the same direction must be all joined together to form a single group. That group is then assembled with one or more links in the opposite direction. The group of links facing in one direction is then secured to one other group having links in the opposite direction.

In the present invention, each assembly would have two links placed in the interior of a third link. Thereafter, an end link is placed to envelop the first two and starts the next assembly to receive two additional links therein. Accordingly, applying the method of U.S. Pat. No. 4,934,135 to the present assembly of links, the pair of adjacent links which are in the interior would be assembled with their gaps oriented in the same direction and these would be secured together. This group would then be connected to the end link oriented with its gap in the opposite direction and secured to that other link.

Figure 8:
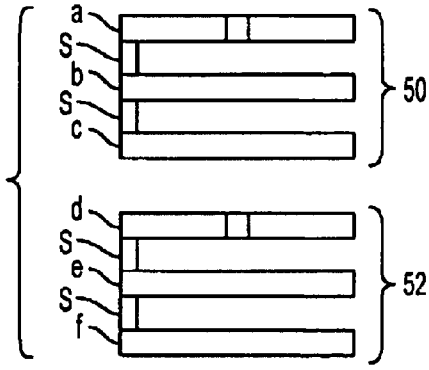
FIGS. 8 shows the combinations of links organized and arranged to form a jewelry rope chain of the present invention.

By way of example, FIG. 8 provides schematically the assembly. Specifically, with reference to FIG. 8, it will be noted that in the first assembly 50, there are links a and b which are placed within the center of a previous link and thereafter link c envelops the other two links. A new assembly 52 is then started with links d and e placed within the center of the previous link and link f enveloping the other two. In this case, it is noted that links b and c have their gaps in the same orientation and are secured together by the solder S. This forms a single group which is then secured again by solder, to link a having its gap in the opposite direction. This same repetition occurs in assembly 52 where links e and f with their gaps in the same direction are secured together by solder and then secured to link f with its gap in the opposite direction.

What is claimed is:

1. A jewelry rope chain, having non-elongated links interwoven together to form a double helix configuration, each link having a substantially uniform cross section, the largest transverse distance across said cross section having a dimension $d_w$, each link having an outer periphery and an inner periphery, and a gap extending one location between the outer and inner peripheries, the inner periphery defining an interior space, the widest dimension of the interior space in a direction consistent with the direction of the gap having a dimension D, and wherein D is between two and three nines $d_w$.

2. A jewelry rope chain as in claim 1, wherein said rope chain is formed by pluralities of assemblies of said links in series, each assembly consisting of two adjacent links, and an end link enveloping said two adjacent links throughout such chain, said two adjacent links having their respective gaps assembled in the same orientation and being fixedly attached to each other to form a group, group being fixedly attached to said end link having a gap orientation about 180 degrees removed with respect to the gaps of the links of said group, and wherein the ratio of D to $d_w$ is approximately 2:1.

3. A jewelry rope chain as in claim 1, wherein said links are hollow links.

4. A jewelry rope chain as in claim 1, wherein said links are solid links.

5. A jewelry rope chain as in claim 1, wherein the dimension D is just over twice the dimension $d_w$.

6. A jewelry rope chain as in claim 1, wherein said links are of annular configuration.

7. A jewelry rope chain as in claim 1, wherein said links have a round cross section.

8. A jewelry rope chain as in claim 1, wherein each of three consecutive links are fixedly connected together to form a cluster, with each cluster not being fixed to the next cluster.

9. A jewelry rope chain as in claim 1, wherein said adjacent links are fixedly held together by solder.

10. A jewelry rope chain as in claim 1, wherein each said links comprise a seam along its inner periphery.

11. A jewelry rope chain as in claim 1, or further having facets formed about said chain.

12. A method of forming a jewelry rope chain having non-elongated links interwoven together to form a double helix configuration, each link having a substantially uniform cross section, the largest transverse distance across said cross section hawing a dimension $d_w$, each link having an outer periphery and an inner periphery, the inner periphery defining an interior space, and a gap extending at one location between the outer and inner periphery, the widest dimension of the interior space in the direction consistent with the direction of the gap having a dimension D, where D is approximately two times $d_w$, the method comprising the steps of fanning a plurality of link assemblies in series, with each assembly consisting of two adjacent links having their respective claps assembled in the same orientation and an end link enveloping the other two adjacent links.

13. The method as in claim 12 and further comprising the steps of:

arranging said two adjacent links with their respective gaps in the same orientation to form a group and fixedly attaching these two links together;

fixedly attaching to said group said end link having a gap orientation about 180 removed from the gaps of the links of said group, and continuing said steps throughout the length of the claim.

14. The method as in claim 12, wherein the ratio of D to $d_w$ is slightly greater than 2:1.

15. The method as in claim 12, wherein said links are hollow links.

16. The method as in claim 12, wherein said links are solid links.

17. The method as in claim 12, wherein said fixing together is through a step of soldering.

18. The method as in claim 12, wherein said links are of annular configuration.

19. The method as in claim 12, wherein said links have a round crass section.

20. The methods in claim 12, and further comprising the step of faceting said chain.

* * * * *